United States Patent [19]

Dubuisson

[11] Patent Number: 4,560,078

[45] Date of Patent: Dec. 24, 1985

[54] CASE WITH ROTARY TELESCOPIC SECTIONS

[76] Inventor: Joseph E. Dubuisson, 241 Brenda Dr., Shreveport, La. 71115

[21] Appl. No.: 653,076

[22] Filed: Sep. 21, 1984

[51] Int. Cl.[4] ..... B65D 21/02; A47B 87/02

[52] U.S. Cl. ..... 220/4 C; 220/4 D; 220/8; 312/201; 206/503

[58] Field of Search ..... 220/4 C, 8, 4 D, 23.6, 220/23.83, 23.86; 206/509, 511, 503; 312/201, 202

[56] References Cited

U.S. PATENT DOCUMENTS

| | | | |
|---|---|---|---|
| 1,289,657 | 12/1918 | Cheney | 312/201 |
| 2,582,421 | 1/1952 | Essman | 312/201 |
| 3,161,315 | 12/1964 | Braun | 220/4 C |
| 3,188,157 | 6/1965 | Rand | 312/202 |
| 3,392,868 | 7/1968 | Pfrommer | 312/201 |
| 3,437,389 | 4/1969 | Perkins | 312/202 |
| 4,155,477 | 5/1979 | Fosher | 220/4 D |

*Primary Examiner*—George E. Lowrance
*Attorney, Agent, or Firm*—Harvey B. Jacobson

[57] ABSTRACT

A tray or case structure comprises a plurality of stacked trays mounted for rotation about a common post. The trays have interengaging catch formations effective to fan the trays out from a retracted superimposed position responsive to manual rotation of the uppermost tray, and depending peripheral skirt portions providing support for each tray. The trays telescope one into another in the retracted position, and the device is useful, for example, as a display device for cosmetics and the like.

9 Claims, 8 Drawing Figures

CASE WITH ROTARY TELESCOPIC SECTIONS

BACKGROUND OF THE INVENTION

This invention relates to a case or tray structure comprising stacked telescopic rotary trays, the structure being suitable for use, for example, as a display device for cosmetics and the like, but which may have diverse analogous uses.

Among objects of the invention are the provision, inter alia, of a self-supporting tray structure of simple yet attractive design, the components of which can be readily manufactured and assembled, and which may comprise a plurality of stacked trays that provide an ample display area when the device is extended, but which retract into compact form.

STATEMENT OF PRIOR ART

Applicant is aware of the following U.S. patents, the relevance of which is that they relate, inter alia, to rotary telescopic structures and stacked tray structures. None of the patents, however, discloses a structure having the features of the present invention.

| | |
|---|---|
| 202,230 | April 9, 1878 |
| 340,176 | April 10, 1886 |
| 386,964 | July 31, 1888 |
| 2,398,091 | April 9, 1946 |
| 3,498,471 | March 3, 1970 |
| Des. 168,727 | Feb. 3, 1953 |

SUMMARY OF THE INVENTION

The present invention provides a structure comprising stacked trays each shaped substantially as a segment of a circle, the trays each having a hub at the apex of the respective segment journalling the tray for rotation about an axis common to all of the trays, the trays being mounted for rotary telescopic movement between a retracted position in which they are superimposed one above another, and an extended position in which the trays occupy adjacent angular positions, the structure including interengaging means between adjacent trays for providing sequential rotary movement of the trays between the retracted position and the extended position responsive to manual rotation of an uppermost tray of the stack from the retracted position.

The interengaging means may, for example, comprise complementary interengaging catches located at the opposite sides of adjacent trays on their upper and lower surfaces respectively, or alternatively the interengaging means may comprise complementary upper and lower part-circular ring-like segments on the hub portions of adjacent trays.

In accordance with a further feature of the invention, each tray may have a depending peripheral skirt extending to the base of the structure to form a support for the tray in both the extended and retracted positions thereof, and as the trays move therebetween. Conveniently, the trays may be in the form of plastic moldings. Where the structure is to be used as a display device for cosmetics, for example, each tray may include a dished depression for receiving same.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Referring initially to FIGS. 1–6, there is shown a rotary telescopic tray structure 10 comprising six trays 12–22 stacked on a common central post 24. The trays have respective ring-shaped hubs 26–36, segment-shaped tray portions 38–48 and depending peripheral skirt portions 50–60 which may be convex in cross section. The trays may be of molded plastic and each tray may be formed with a dish-like depression such as depression 62 (FIG. 5) in the tray portion, for a cosmetic sample and the like.

Figure 1:
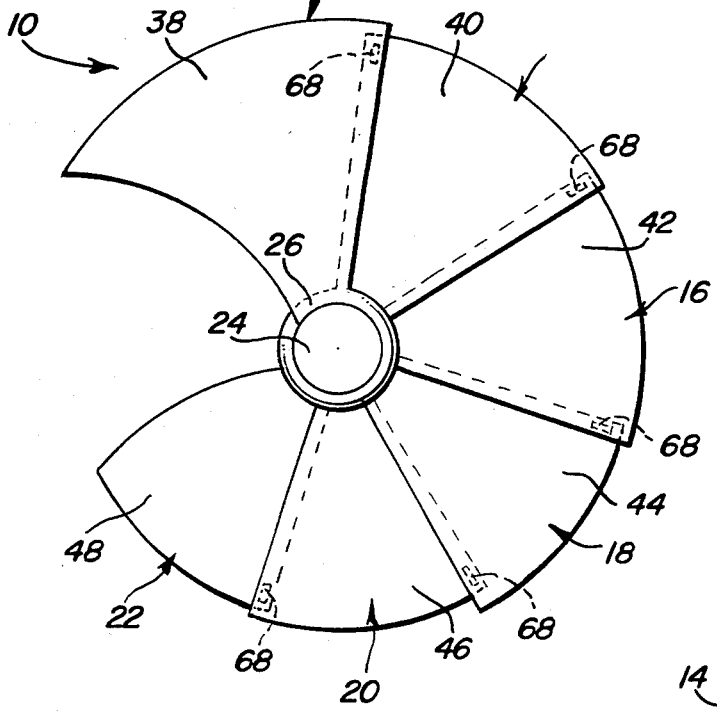
FIG. 1 is a plan view of a tray structure in accordance with the invention in extended position.
Figure 5:
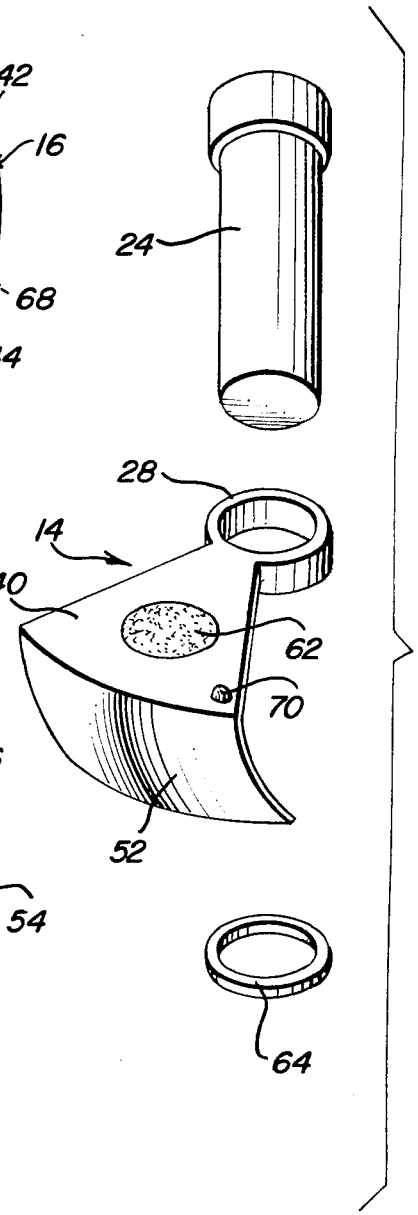
FIG. 5 is an exploded view of one of the trays, a support post and a bearing sleeve.
Figure 2:
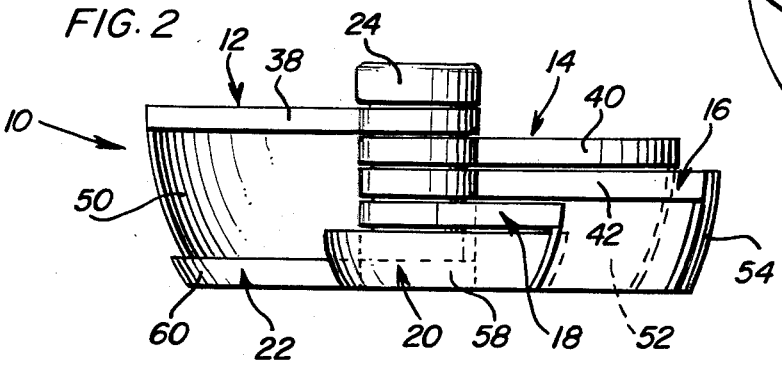
FIG. 2 is an elevational view of the structure in extended position.
Figure 6:
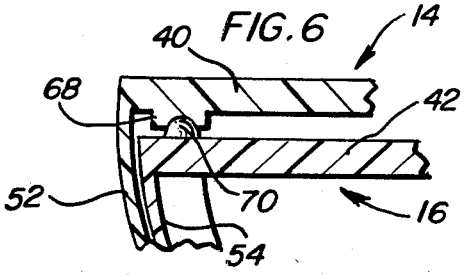
FIG. 6 is an enlarged sectional view of part of the structure.
Figure 3:
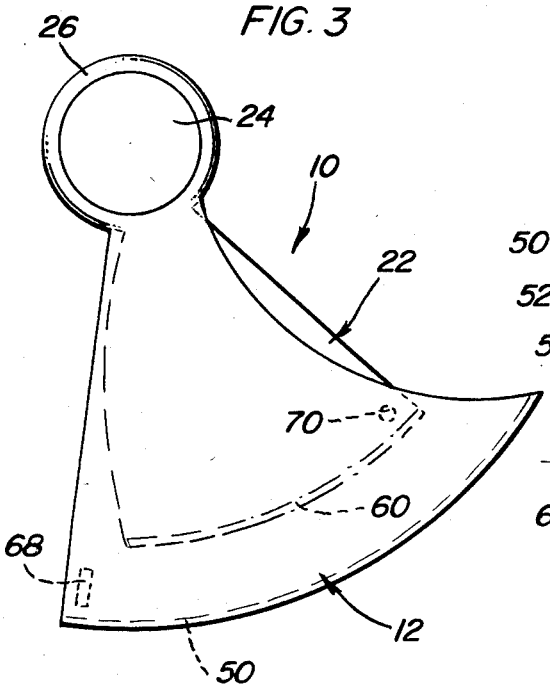
FIG. 3 is a plan view of the structure in retracted position.
Figure 4:
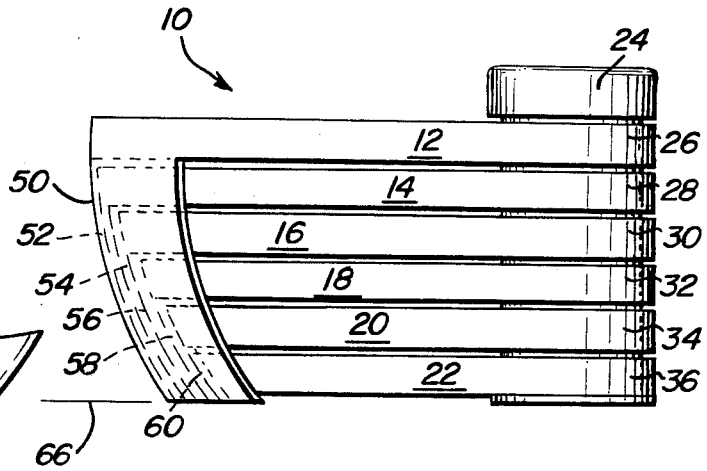
FIG. 4 is an elevational view of the structure in retracted position.

The trays are journalled one upon another on post 24 with interposed bearing rings, such as ring 64 (FIG. 5) and the dimensions of each tray and the height of each skirt portion are such that the trays can be telescoped into retracted position, one within another, with each skirt portion resting on a support surface 66 (FIGS. 3 and 4) and the trays can be sequentially opened into an extended position (FIGS. 1 and 2) by manually rotating uppermost tray 12 in a counterclockwise direction from the position shown in FIG. 3. Further, each tray except bottom tray 22 has a catch 68 on its undersurface adjacent one peripheral corner of the tray, and each tray except the uppermost tray 12 has an interengaging catch 70 on its upper surface adjacent the other peripheral corner of the tray. Accordingly, as upper tray 12 is rotated from the retracted position of the stack, the trays will fan out into the extended position with a preceding tray pulling out the succeeding tray below it when the respective catches engage one another. The trays can be closed into the retracted position in similar manner. Throughout movement of the trays, and both in the extended and retracted positions of the device, the trays are supported individually on their respective skirt portions.

Figure 8:
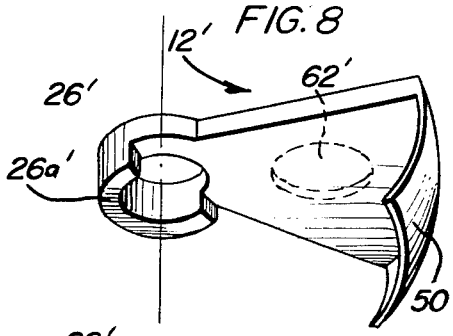
FIG. 8 is an exploded view of a pair of tray components of the modified structure.
Figure 7:
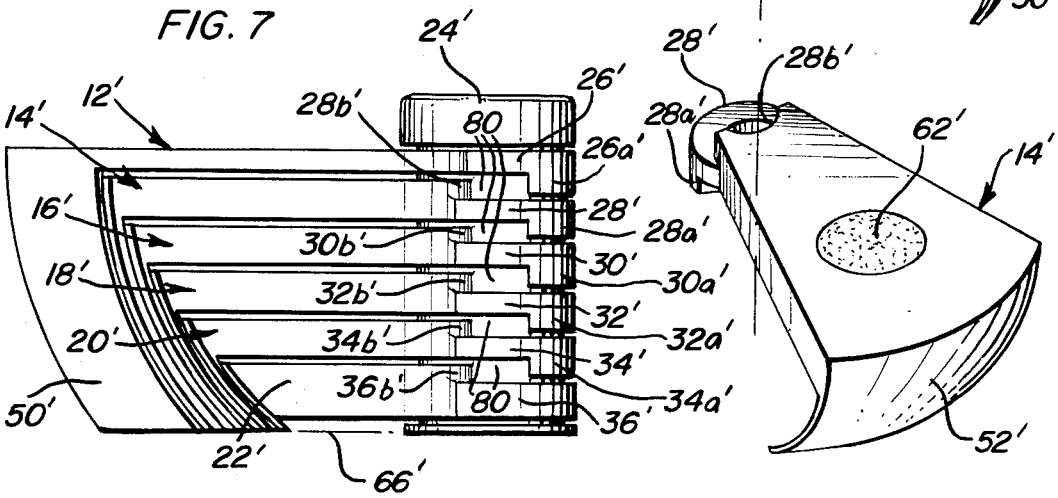
FIG. 7 is a view similar to FIG. 4 of a modified form of the structure.

In the modified form of the apparatus shown in FIGS. 7 and 8, the interengaging catches 68, 70 of the previous embodiment are replaced by interengaging ring segments on the upper and lower surfaces of the hubs 26′–36′ of the respective trays. The ring segments on the lower surfaces are denoted by an "a" suffix, and the ring segments on the upper surfaces by a "b" suffix. The extent of the ring segments is such that in the retracted position of the structure (FIG. 7) gaps 80 are formed between the ends of the upper and lower ring segments of adjacent trays. The gaps provide freedom of rotation of each tray until the adjacent ends of the respective ring segments come into engagement whereupon an upper tray will again pull on a lower tray with this action being repeated from tray-to-tray so as to fan the trays out in like manner to the previous embodiment. A like interengaging action is obtained at the opposite ends of the respective ring segments when closing the structure.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A structure comprising a plurality of stacked trays each having a tray portion and a hub portion extending from the tray portion for rotationally journalling the tray about an axis common to all of the trays, the trays being mounted for rotary movement between a retracted position in which they are superimposed one above another and an extended position in which the trays occupy adjacent angular positions, the structure including interengaging means between adjacent trays for providing sequential rotary movement of the trays effective to fan the trays out into the extended position responsive to rotation of the uppermost tray of the stack from the retracted position, wherein the tray portion of each tray is shaped substantially as a segment of a circle, the hub portion is located at the apex of the circle, each tray has a depending peripheral skirt opposite the hub portion, and wherein the trays are of successively smaller diameter from the uppermost tray down the plurality of trays so that the trays telescope into a nested configuration in the retracted position thereof.

2. A structure comprising a plurality of stacked trays each having a tray portion and a hub portion extending from the tray portion for rotationally journalling the tray about an axis common to all of the trays, the trays being mounted for rotary movement between a retracted position in which they are superimposed one above another and an extended position in which the trays occupy adjacent angular positions, the structure including interengaging means between adjacent trays for providing sequential rotary movement of the trays effective to fan the trays out into the extended position responsive to rotation of the uppermost tray of the stack from the retracted position, wherein each tray has a depending peripheral skirt opposite the hub portion, the skirt extending to the base of the structure for providing a support for the tray, the trays being configured for telescoping one within another in the retracted position of the structure.

3. The invention of claim 2 wherein the skirt of each tray is convex in cross section.

4. The invention of claim 2 wherein the tray portion of each tray is shaped substantially as a segment of a circle, and the hub portion is located at the apex of the segment.

5. The invention of claim 1 wherein the interengaging means comprises complementary interengaging catches on opposite sides respectively of adjacent trays.

6. The invention of claim 5 wherein the catches are located respectively on an undersurface of a tray above, on an upper surface of an adjacent tray therebelow, and toward opposite peripheral corners of the respective trays.

7. A structure comprising a plurality of stacked trays each having a tray portion and a hub portion extending from the tray portion for rotationally journalling the tray about an axis common to all of the trays, the trays being mounted for rotary movement between a retracted position in which they are superimposed one above another and an extended position in which the trays occupy adjacent angular positions, the structure including interengaging means between adjacent trays for providing sequential rotary movement of the trays effective to fan the trays out into the extended position responsive to rotation of the uppermost tray of the stack from the retracted position wherein the hub portions of the respective trays comprise respective ring members mounted one above another on a support shaft and wherein the interengaging means comprise complementary upper and lower ring-lke segments associated with the ring members with gaps formed between the segments of adjacent trays when the structure is in retracted position providing a degree of free rotation of each tray prior to engagement of the segments.

8. The invention of claim 1 wherein the trays are plastic moldings.

9. The invention of claim 1 wherein the tray portion of each tray is formed with a dished depression for receiving a cosmetic sample or the like.

* * * * *